US006817274B1

(12) United States Patent
Georgiades

(10) Patent No.: US 6,817,274 B1
(45) Date of Patent: Nov. 16, 2004

(54) CAM DRIVEN PIN STRIPPING DEVICE

(75) Inventor: Greg Georgiades, Longmeadow, MA (US)

(73) Assignee: Winkler + Dunnebier, AG (DE)

( * ) Notice: Subject to any disclaimer, the term of this patent is extended or adjusted under 35 U.S.C. 154(b) by 52 days.

(21) Appl. No.: 10/712,192

(22) Filed: Nov. 13, 2003

(51) Int. Cl.[7] ..... B31B 49/00

(52) U.S. Cl. ..... 83/103; 83/346; 493/82; 493/342

(58) Field of Search ..... 83/103, 107, 343, 83/117, 128, 151, 154, 331, 345, 665, 346, 698–670; 493/373, 422, 82, 83, 342, 472; 225/93, 97–99

(56) References Cited

U.S. PATENT DOCUMENTS 2,088,118 A * 7/1937 Schillo ..... 83/117
3,371,584 A * 3/1968 Zernov ..... 493/373
3,524,364 A * 8/1970 Bishop ..... 83/103
3,956,974 A * 5/1976 Schroter ..... 493/342
4,031,816 A * 6/1977 Matsuo ..... 493/373
4,598,619 A * 7/1986 Leeper et al. ..... 83/117
4,604,931 A * 8/1986 Bastian et al. ..... 83/665
5,049,122 A * 9/1991 Marschke ..... 493/373
5,087,237 A * 2/1992 Nunley ..... 493/342
5,103,706 A * 4/1992 Rosemann ..... 83/670
5,300,009 A * 4/1994 Bittenbender ..... 493/373
5,365,815 A * 11/1994 Pfaff, Jr. ..... 83/154
5,697,878 A * 12/1997 Elkis ..... 493/373
6,513,750 B2 * 2/2003 Miller ..... 242/527.1

* cited by examiner

*Primary Examiner*—Allan Shoap
*Assistant Examiner*—Ghassem Alie
(74) *Attorney, Agent, or Firm*—Shook, Hardy & Bacon L.L.P.

(57) ABSTRACT

The present invention generally encompasses a device for removing waste material from a blank. The invention includes a rotatable stripping pin housing and a stationary cam. The stripping pin housing includes a number of radially extending grooves in its axial surface. Each groove terminates at an aperture located in the stripping pin housing's circumferential surface. A stripping pin apparatus having an radially outwardly extending stripping pin capable of penetrating waste material and an axially extending cam follower is position within each groove. Each cam follower is engaged within a cam track in the stationary cam. The stripping pin housing is placed so that the stripping pins will engage waste material (and not the blank) as the material passes the device. Thereafter, the stripping pin housing is rotated causing the cam followers to travel along the cam track so that the radial location of the cam track determining the radial position of the stripping pins.

29 Claims, 5 Drawing Sheets

CAM DRIVEN PIN STRIPPING DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a device for removing waste material from a blank. More particularly, this invention provides a device for removing waste material from a blank that includes a rotatable cylinder having a number of radially extendable stripping pins for engaging waste material.

The production of a blank, such as an envelope or carton blank, typically occurs in several steps. First, a cutting device cuts a web of paper or other suitable material into a blank portion and waste portion (the waste portion is sometimes referred to as a "chip"). The waste portion may be located around the exterior of the blank or may be positioned within the blank if, for example, the end product has a window. Next, a conveying device transports the cut material to a waste removal device that separates the waste portion from the blank portion. Finally, a second conveying device transports the blank portion to a folding machine where it is folded into the end product or to a packing station where a number of blanks are gathered together and processed for outside transportation. This process is usually automated and may be performed by a single machine or by multiple machines.

There are several types of cutting devices. For example, one cutting device operates by stamping a sheet of material with a die to form the blank portion and the waste portion. Another popular device generally comprises two cylinders, each positioned so that their longitudinal axis extends horizontally, with the top cylinder located a short distance above the bottom cylinder. A male die and a female die are coupled to the cylinders so that as the cylinders rotate a passing web is engaged between the dies and cut into a blank portion and a waste portion.

One popular waste separation device resembles the second cutting device described above, that is, it has two cylinders, each positioned so that their longitudinal axis extends horizontally, with the top cylinder located a short distance above the bottom cylinder. The bottom cylinder includes a number of pins extending from its surface and positioned so that when the cylinders rotate and the blank and waste portions pass between the cylinders, the pins penetrate the waste portion. In this manner, the waste material is coupled to the cylinder while the carton blank exits the device. This device is commonly called a pin stripping device.

Several methods are employed to remove the waste portion from the typical two-cylinder pin stripping device. One method involves positioning a plate close to the cylinder containing the pins so that there is a narrow gap between the plate and the tip of the pins. As the cylinder rotates, the leading edge of the plate will slide under the leading edge of the waste material and strip the waste material from the pins. Another method for removing waste from a pin stripping device involves providing a compressed air source coupled to a fluid path that terminates at the surface of the cylinder in close proximity to the pins. After the waste portion is removed from the blank portion and the cylinder has rotated some distance, the compressed air source is engaged to force air through the fluid path to impact on the waste portion and force the waste portion from the pins.

Each of the typical methods for removing waste from a pin stripping device has problems. In the first method, it is difficult to properly position the stripping plate because the plate must be close to and yet not inhibit the pins. If the plate is not positioned properly, it may not catch the leading edge of the waste thereby allowing waste to become jammed between the plate and the cylinder. Additionally, occasionally, one or more portions of waste material may be curled or pressed closely to the bottom cylinder so that the stripping plate will not catch the leading edge of that portion of the waste material. Over time the retained waste will build up and cause the device to jam. In the second method, the waste material may be pressed onto the pins far enough so that the compressed air system will not be strong enough to force the waste portion from the pins. Furthermore, a compressed air source adds complexity to the process in that additional mechanical devices, fittings and tubing are required with the attendant servicing and maintenance.

When material is jammed in the machine, operators may have to shut down the manufacturing process until the problem is corrected. Furthermore, if the waste material is not fully removed during the stripping process, then multiple pieces of waste material may accumulate on the bottom cylinder and thereby reduce the piercing effectiveness of the pins. This unwanted build-up of waste material also can force operators to suspend the manufacturing process. Thus, the use of such pin stripping devices often results in manufacturing delays and increased production costs.

Accordingly, there is a need for a device such as the present invention that will separate waste material from a carton blank without jamming or otherwise causing a delay in the manufacturing process. The present invention also may be utilized to perform various other objectives that will be apparent to those in the art.

SUMMARY OF THE INVENTION

The present invention generally encompasses a device for removing waste material from a blank. The invention includes a rotatable stripping pin housing and a stationary cam. The stripping pin housing includes a number of radially extending grooves positioned on its axial surface, with each groove terminating at an aperture located in the stripping pin housing's circumferential surface. A pin stripping apparatus that includes a radially extending stripping pin and an axially extending cam follower is positioned within each groove. The grooves are sized so that the stripping pin apparatus can slide radially thereby causing the stripping pin to extend from the aperture in the stripping pin housing's circumferential surface. Each axially extending cam follower is engaged within a cam track formed in the stationary cam, and the cam track is defined at varying distances from the circumferential surface of the cam. In operation, the device is placed so that the stripping pins will engage waste material (and not the blank) as the material passes the device. Thereafter, the stripping pin housing is rotated which causes the cam followers to travel around the cam track so that the radial location of the cam track determines the extent the stripping pins extend from the circumferential surface of the stripping pin housing.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

Figure 1:
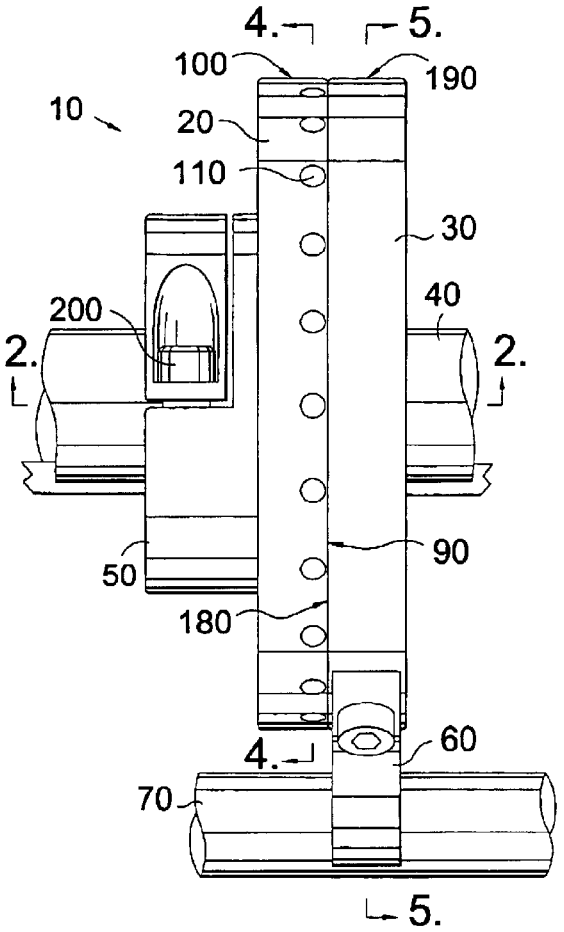
FIG. 1 is a side view of one embodiment of the present invention.

The present invention provides a cam-driven pin stripping device that is uniquely suited to separating waste material from a blank without jamming or otherwise causing a delay in the manufacturing process. Referring first to FIG. 1, a cam-driven pin stripping device according to one embodiment of the present invention is generally referred to by the numeral 10. Device 10 includes a stripping pin housing 20, a cam 30, and a drive shaft 40. Device 10 may also include a stripping pin housing hub 50, a cam lock 60, and a cam lock shaft 70.

Stripping pin housing 20 is a disc with a hole defined along its central longitudinal axis. With additional reference to FIG. 2, stripping pin housing 20 includes a number of stripping pin slide block grooves 80 in its inner axial surface 90 and near its circumferential surface 100. In this embodiment, stripping pin slide block grooves 80 have a generally rectangular radial cross-section and include an aperture 110 defined in circumferential surface 100. It should be understood that the shape of stripping pin slide block grooves 80 is determined by the shape of the stripping pin apparatus employed. Thus, additional groove shapes are within the scope of this invention.

Figure 2:
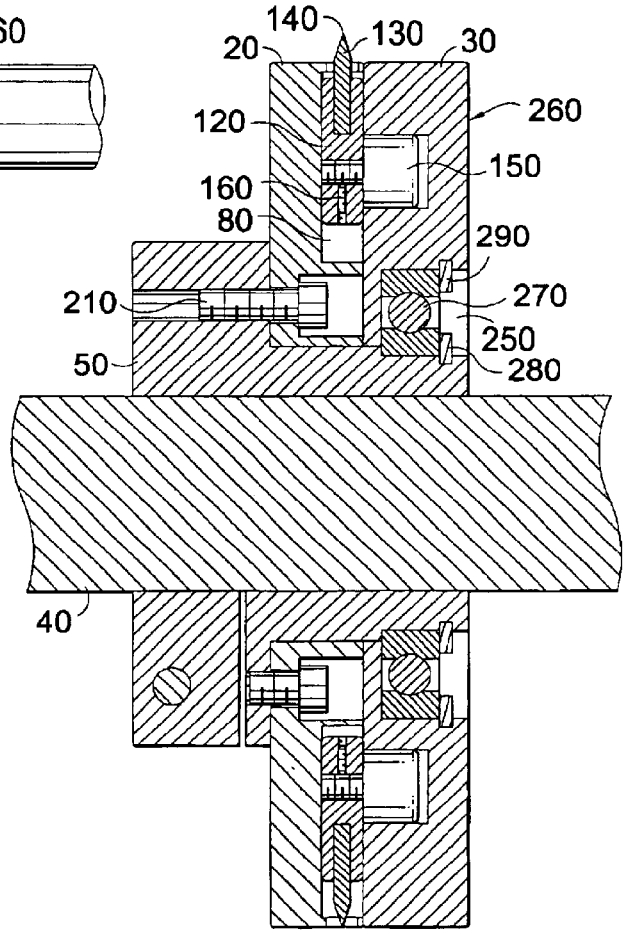
FIG. 2 is a top view of the device shown in FIG. 1 taken along line 2-2 in FIG. 1.

Continuing with FIG. 2, a stripping pin slide block 120 is positioned in each stripping pin slide block groove 80. Each stripping pin slide block 120 has a striping pin 130 extending toward circumferential surface 100 of stripping pin housing 20. Stripping pin 130 is sized so that it will fit within aperture 110 in circumferential surface 100 and terminates in a sharp point 140 capable of piercing waste material. A cam follower 150 is coupled to stripping pin slide block 120 so that it extends from axial surface 90 of stripping pin housing 20. In this embodiment, cam follower 150 is a screw and, therefore, stripping pin slide block 120 defines a threaded hole for coupling cam follower 150 to stripping pin slide block 120. Stripping pin slide block 120 also includes a setscrew 160 engaged in a threaded hole. Setscrew 160 terminates on cam follower 150 so that when setscrew 160 is tightened, cam follower 150 is held in place.

Figure 5:
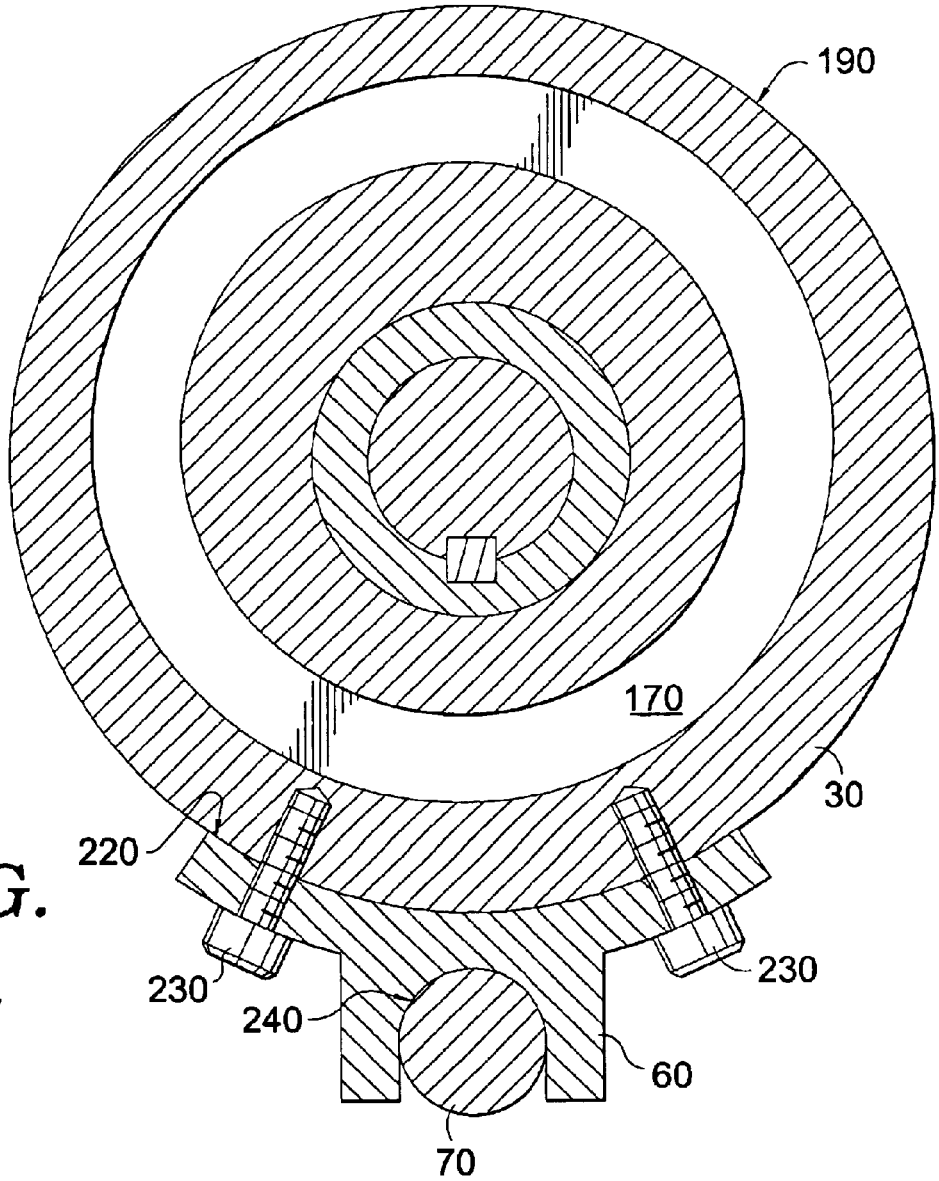
FIG. 5 is a front view of a cam profile according to the embodiment of the invention shown in FIG. 1 taken along line 5-5 in FIG. 1.

Cam 30 is also a disc with a hole defined along its central longitudinal axis. With reference to FIGS. 1 and 5, cam 30 defines a cam track 170 in its inner axial surface 180. Cam track 170 is a groove or channel that has been bored or machined in inner axial surface 180. The width of cam track 170 is approximately equal to the diameter of that portion of cam follower 150 that extends from stripping pin slide block body 120. The depth of cam track 170 is approximately equal to the length of the portion of cam follower 150 that extends from stripping pin slide block body 120. The shape of cam track 170 is generally oval. However, as will be explained below, portions of cam track 170 are closer to circumferential surface 190 of cam 30 than other portions.

Returning to FIGS. 1 and 2, stripping pin housing hub 50 defines a generally cylindrical shaped axial chamber having a diameter approximately equal to the diameter of drive shaft 40 so that drive shaft 40 may extend through the chamber. A screw 200 is used to fixedly couple stripping pin housing hub 50 to drive shaft 40. When screw 200 is tightened, a portion of the axial chamber defined by stripping pin housing hub 50 constricts on drive shaft 40 so that stripping pin housing hub 50 is locked in a fixed position on drive shaft 40. It should be understood that other means exist for attaching stripping pin housing hub 50 to drive shaft 40 and are included within the scope of this invention. For example, stripping pin housing hub 50 may be formed from two generally equivalent parts, and two screws 200 may be utilized to tighten the two parts together thereby constricting longitudinal chamber on drive shaft 40. As another example, screw 200 may be used as a setscrew, that is, it may be positioned so that it impacts on drive shaft 40.

As shown in FIG. 2, stripping pin housing hub 50 extends through the central longitudinal axis holes defined in stripping pin housing 20 and cam 30. Thus, it can be said that stripping pin housing 20 and cam 30 are mounted on stripping pin hub 50 which is coupled to drive shaft 40. However, stripping pin housing 20 is coupled to stripping pin housing hub 50 by screws 210, while cam 30 is not coupled to stripping pin housing hub 50. In this embodiment, three screws 210 (see FIG. 4) are used although it should be understood that the present invention is not limited by the number of screws 210. With stripping pin housing hub 50 coupled to rotatable drive shaft 40 as described above and stripping pin housing 20 coupled to stripping pin housing hub 50, the rotation of drive shaft 40 causes stripping pin housing 20 to rotate.

Although mounted on stripping pin housing hub 50, cam 30 is coupled to cam lock shaft 70 by cam lock 60. As shown in FIGS. 1 and 5, the top surface 220 of cam lock 60 is curved and has a radius that is approximately equal to the outer radius of cam 30 so that cam 30 fits snugly against cam lock 60. Two threaded holes extend through cam lock 60 and are positioned to correspond to two radially extending threaded holes in cam 30. Two screws 230 are applied through the threaded holes extending through cam lock 60 and into the two threaded holes in cam 30 to couple cam 30 to cam lock 60. As with stripping pin housing hub 50, it should be understood that other means exist for attaching cam lock 60 to cam lock shaft 70 and are included within the scope of this invention.

Cam lock 60 also includes two legs that extend generally downwardly, and between the two legs is an inner curved surface 240 that has a radius approximately equal to the radius of cam lock shaft 70 so that cam lock shaft 70 fits snugly against inner curved surface 240. Thus, cam lock shaft 70 prevents cam lock 60 and cam 30, when it is coupled to cam lock 60, from rotating when drive shaft 40 rotates stripping pin housing hub 50 and stripping pin housing 20.

Cam 30 is also restricted from moving along the length of cam lock shaft 70 or drive shaft 40. As seen in FIG. 2, cam 30 includes a circular channel 250 on its outer axial surface 260, and a ball bearing 270 is positioned within channel 250. An inner snap ring 280 is coupled to stripping pin housing hub 50 and extends within channel 250 outside of ball bearing 270. An outer snap ring 290 is coupled to cam 30 and extends within channel 250 outside of ball bearing 270 and opposite of inner snap ring 280. Snap rings 280 and 290 act to restrain ball bearing 270 within channel 250 when stripping pin housing hub 50 is rotating and cam 30 is not rotating. Thus, ball bearing 270 effectively couples cam 30 to stripping pin housing hub 50 to prevent cam 30 from moving along either drive shaft 40 or cam lock shaft 70 during operation of the device.

As shown in FIGS. 1 and 2 and as discussed above, when device 10 is assembled, stripping pin housing hub 50 is coupled to drive shaft 40, and stripping pin housing 20 is mounted on and coupled to stripping pin housing hub 50 so that it will rotate when drive shaft 40 rotates. Cam lock 60 is mounted on cam lock shaft 70 and coupled to cam 30, which is mounted on but not coupled to stripping pin housing hub 50. Cam 30 and stripping pin housing 20 are positioned so that axial surface 90 of cam 30 is adjacent to axial surface 180 of stripping pin housing 20 and cam followers 150 are engaged securely within cam track 170.

As shown in FIG. 5, cam track 170 is formed so that certain portions of cam track 170 lie closer to circumferential surface 190 of cam 30 than other portions. Thus, with cam followers 150 securely situated in cam track 170, the radial position of cam track 170 defines the radial position of stripping pins 130 as shown in FIGS. 3 and 4.

Figure 3:
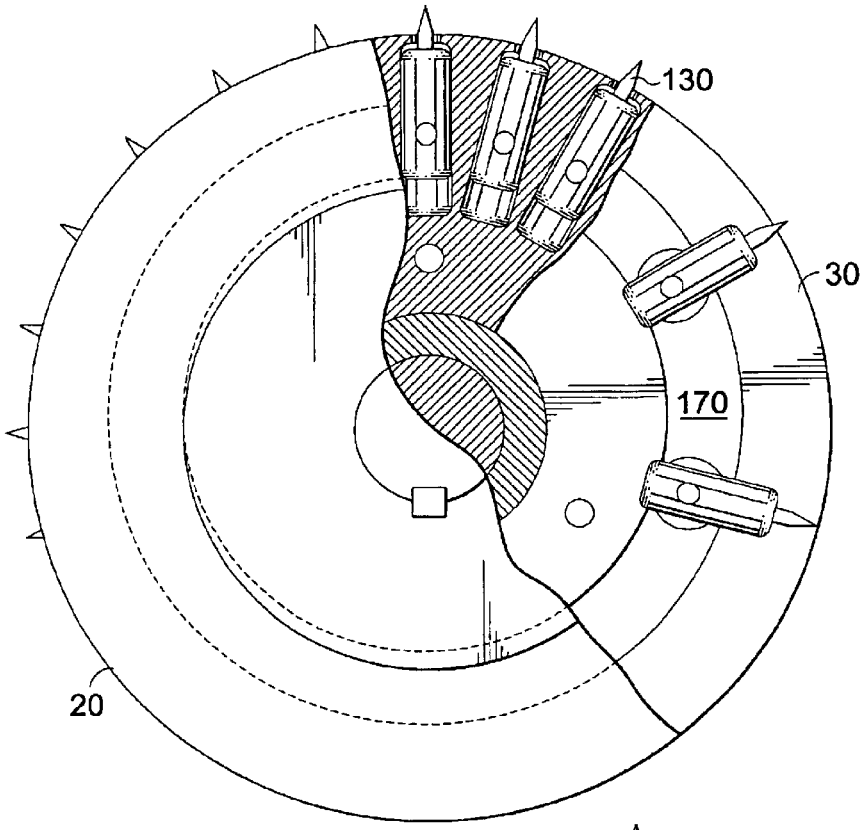
FIG. 3 is a front view of the stripping pin housing shown in FIG. 1 with parts cut away.
Figure 4:
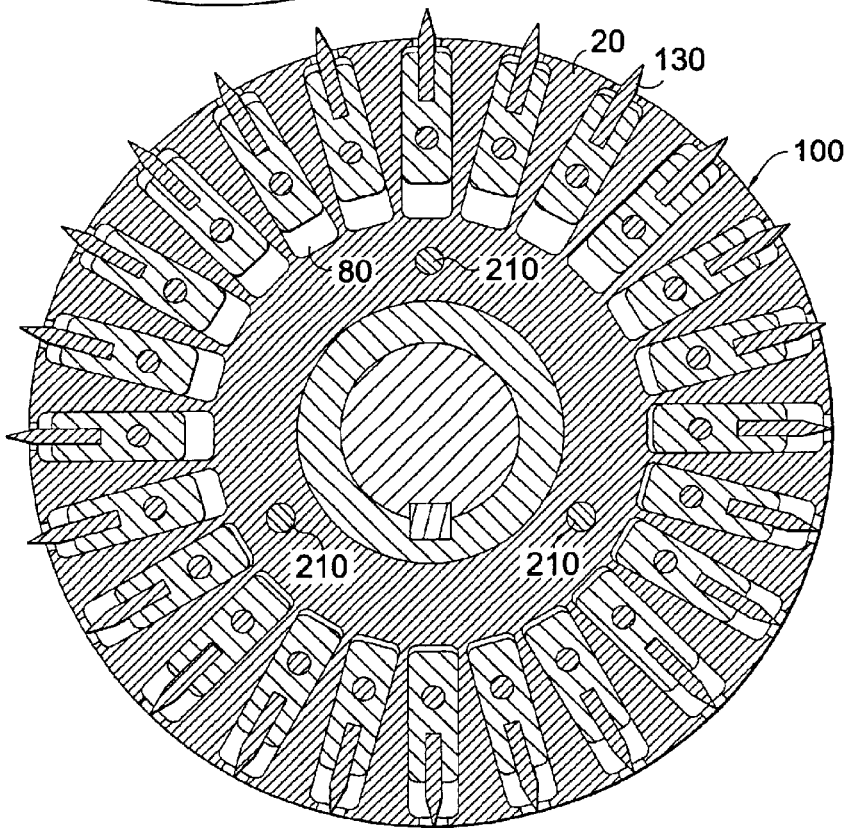
FIG. 4 is a front view of a rotatable cylinder according to the embodiment of the invention shown in FIG. 1 taken along line 4-4 in FIG. 1.

As seen in FIGS. 3 and 4, the location of cam track 170 causes the stripping pin 130 currently located at approximately the 9 o'clock position to extend just beyond circumferential surface 100 of stripping pin housing 20. Continuing clockwise towards the 12 o'clock position, the location of cam track 170 causes each consecutive stripping pins 130 to extend slightly farther past circumferential surface 100. At the 12 o'clock position, the location of cam track 170 causes the stripping pin 130 at that position to reach its greatest extension beyond circumferential surface 100. Continuing clockwise towards the 3 o'clock position, the location of cam track 170 causes each consecutive stripping pin 130 to extend a shorter distance past circumferential surface 100. Finally, at approximately 3 o'clock position, the location of cam track 170 causes the stripping pin 130 at that position to return below circumferential surface 100. Thus, when stripping pin housing 20 rotates each individual stripping pin 130 starts to extend beyond circumferential surface 100 at approximately the 9 o'clock position, is fully extended at the 12 o'clock position, and is fully retracted by approximately the 3 o'clock position. Of course, it should be understood that stripping pin housing 20 may rotate in the opposite direction so that each individual stripping pin 130 starts to extend beyond circumferential surface 100 at approximately the 3 o'clock position, is fully extended at the 12 o'clock position, and is fully retracted by approximately the 9 o'clock position It should be understood that drive shaft 40 is coupled to a motor or other device, which is not shown, that will cause drive shaft 40 to rotate. With cam 30 remaining stationary, the rotation of drive shaft 40 causes stripping pin housing hub 50 and, consequently, stripping pin housing 20 and the stripping pin apparatus positioned within grooves 80 to rotate. The rotation of stripping pin housing 20 causes cam followers 150 to travel around cam track 170, which causes the radial position of stripping pins 130 to vary as described above.

Figure 6:
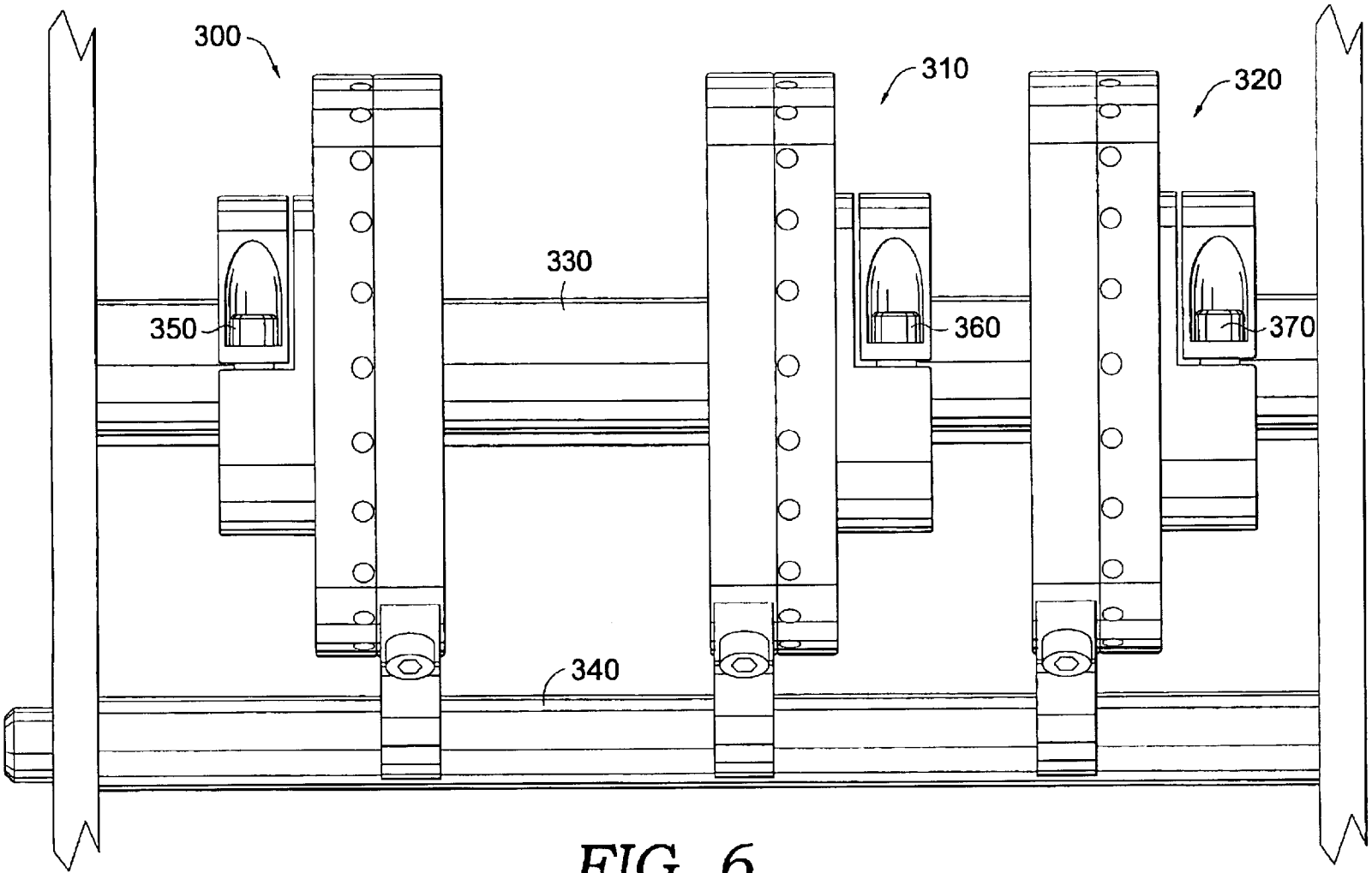
FIGS. 6 and 7 are a views of the system for producing a carton blank that employ embodiments of the present invention.

FIG. 6 shows three devices 300, 310 and 320 according to the present invention positioned on a drive shaft 330 and a cam lock shaft 340. Before initiating a waste removal operation, a user may position devices 300, 310 and 320 laterally along drive shaft 330 and cam lock shaft 340 so that the devices' stripping pins will pierce waste material as it passes the devices. In FIG. 6, for example, devices 300 and 320 may be positioned to pierce waste material located at the outer edges of a sheet or web and device 310 may be positioned to pierce waste material located in the interior of the sheet or web. By loosening screws 350, 360 or 370, devices 300, 310 or 320 respectively may be moved laterally and repositioned along drive shaft 330 and cam lock shaft 340 to remove waste from a different blank. It should be understood that if the sheet or web has no waste located at its interior, then device 310 is not needed and may be removed. Likewise, additional devices may be positioned on a drive shaft 330 and a cam lock shaft 340 as needed.

Figure 7:
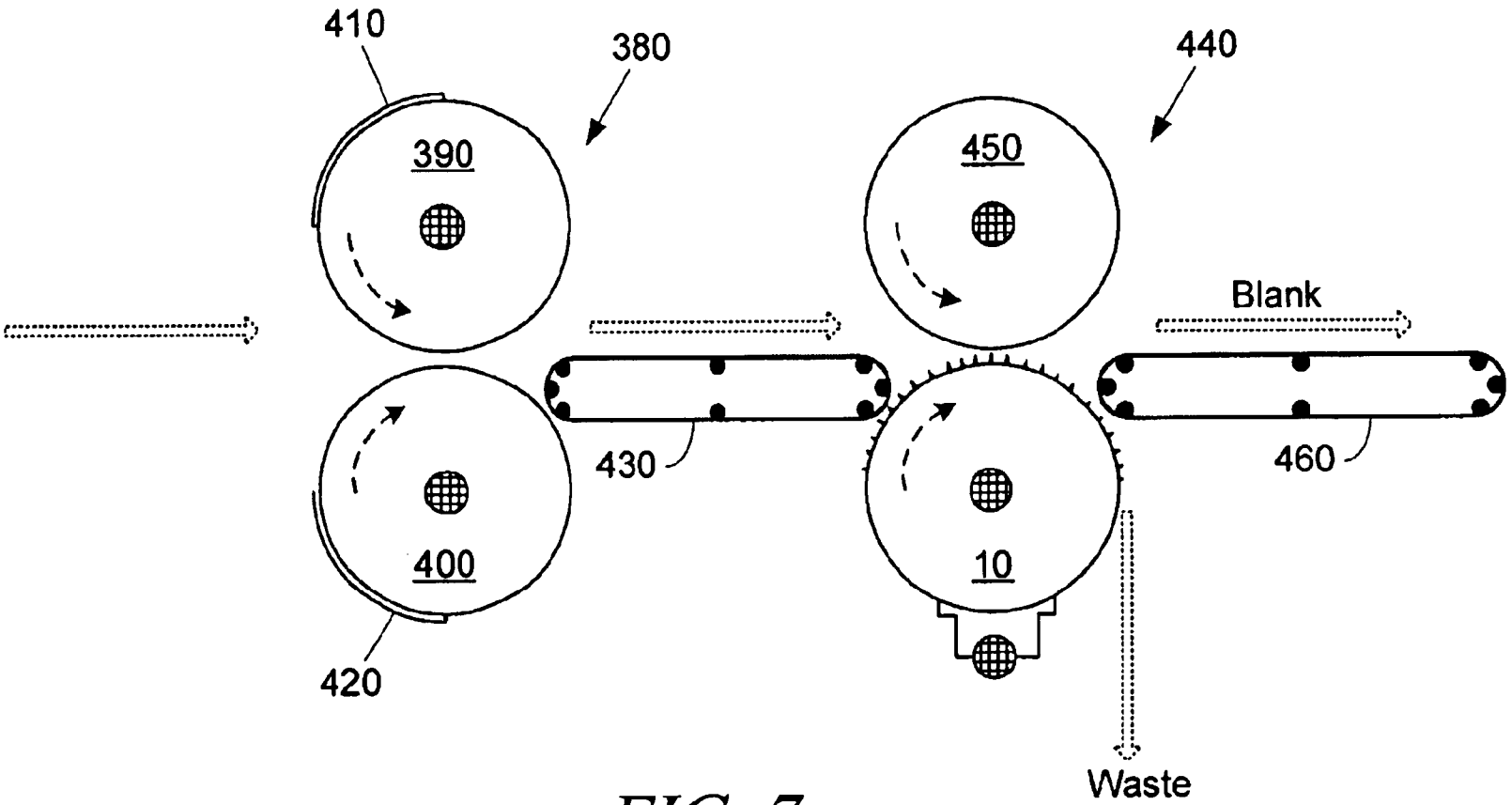

FIG. 7 shows a system in which device 10 may be employed to remove waste from a blank. The system includes a cutting device 380 that, in this embodiment, is made up of a top cylinder 390 and a bottom cylinder 400, each positioned so that their longitudinal axis extends horizontally, with top cylinder 390 located a short distance above bottom cylinder 400. Two die, 410 and 420, are coupled to cylinders 390 and 400 respectively and positioned so that as cylinders 390 and 400 rotate die 410 and 420 come together to cut a passing web or sheet into a blank portion and a waste portion. The web is fed into cutting device 380 from a web in-feed (not shown), which may be a sheet feeder or the like. The system also includes conveyor belt 430, which is operable to convey the cut web or sheet from cutting device 380 to waste removal device 440.

Waste removal device 440 includes device 10 and a cylinder 450 that is covered by rubber or other similar material. As with top cylinder 390 and bottom cylinder 400, device 10 and cylinder 450 are positioned so that their longitudinal axis extends horizontally and so that there is only a very small space between. The rotation of device 10 causes the extension of stripping pins 130 as discussed above so that waste portions passing between device 10 and cylinder 450 are punctured and thereby coupled to device 10. The material surrounding the surface of cylinder 450 protects that cylinder from damage as it operates to prevent vertical movement of the waste and blank portions as they pass.

The continued rotation of device 10 causes stripping pins 130 to withdraw into device 10 after they have punctured the waste portion. When the pins are fully withdrawn, the waste portion is no longer coupled to device 10 and is free to fall (as indicated) into a waste bin or other device for removal or other use, such as recycling. Thus, the blank will continue as indicated by the dashed arrow in FIG. 7 along conveyor belt 460 to the next station while the waste portion is removed.

It should be understood that the cutting device and conveying devices shown in FIG. 7 and disclosed above are exemplary only and not intended to limit the scope of this invention. The removal device of the present invention may be employed with any number of cutting devices and conveying devices.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

The invention claimed is:

1. A device for removing waste from a blank, said device comprising:

a rotatable cylindrical stripping pin housing, said stripping pin housing defining a plurality of grooves in one of its axial surfaces, with each groove having an aperture in the circumferential surface of said stripping pin housing, each of said grooves containing a stripping pin apparatus, said stripping pin apparatus including a stripping pin oriented to extend through said aperture and a cam follower extending from said axial surface; and a stationary cam, said cam defining a cam track in an axial surface;

wherein said housing is positioned adjacent to said cam profile so that said cam followers extend into and are securely positioned in said cam track; and wherein said cam track is defined so that when a cam follower travels around said cam track the stripping pin coupled to said cam follower extends past circumferential surface and then retract below said circumferential surface.

2. The device of claim 1 further including a rotatable drive shaft, s coupled to said stripping pin housing.

3. The device of claim 2 further including a stripping pin housing hub wherein said stripping pin housing hub is utilized to couple said drive shaft to said stripping pin housing.

4. The device of claim 2 further including a motor coupled to said drive shaft, said motor operable rotate said drive shaft.

5. The device of claim 1 further including a cam lock coupled to said cam profile.

6. The device of claim 5 further including a stationary cam lock shaft coupled to said cam lock.

7. The device of claim 1 wherein said cam is a cylinder.

8. The device of claim 1 wherein said stripping pins extend from said circumferential surface for one half of said circumferential surface.

9. The device of claim 1 wherein said stripping pins extend from said circumferential surface for one quarter of said circumferential surface.

10. A device for removing waste from a blank, said device comprising:

a rotatable cylindrical stripping pin housing, said housing defining a plurality of grooves in one axial surface, with each groove including an aperture defined in the circumferential surface of said stripping pin housing, each of said grooves containing a stripping pin apparatus, said stripping pin apparatus including a stripping pin oriented to extend through said aperture and a cam follower extending from said axial surface;

a cam, said cam defining a cam track in an axial surface;

means for rotating said stripping pin housing; and means for maintaining said cam in a stationary position;

wherein said stripping pin housing is positioned adjacent to said cam so that said cam followers extend into and are securely positioned in said cam track; and wherein said cam track is defined so that when a cam follower travels around said cam track the stripping pin coupled to said cam follower extends past circumferential surface and then retract below said circumferential surface.

11. The device of claim 10 wherein said means for rotating said stripping pin housing includes a motor.

12. The device of claim 11 wherein said means for rotating said stripping pin housing further includes a drive shaft coupled to said motor and to said housing.

13. The device of claim 12 wherein a stripping pin housing hub is utilized to couple said stripping pin housing to said drive shaft.

14. The device of claim 10 wherein said means for maintaining said cam in a stationary position includes a cam lock shaft.

15. The device of claim 14 wherein said means for maintaining said cam in a stationary position further includes a cam lock coupled to said cam and said cam lock shaft.

16. The device of claim 10 wherein said cam is a cylinder.

17. The device of claim 10 wherein said stripping pins extend from said circumferential surface for one half of said circumferential surface.

18. The device of claim 10 wherein said stripping pins extend from said circumferential surface for one quarter of said circumferential surface.

19. A system for creating a blank from a sheet of material, said system comprising:

a cutting device, said cutting device operable to cut said sheet of material into a blank portion and a waste portion; and a waste removal device, said device including a rotatable cylindrical stripping pin housing, said housing defining a plurality of grooves, with each groove having an aperture in the circumferential surface of said housing, each of said grooves containing a stripping pin apparatus, said stripping pin apparatus including a stripping pin oriented to extend through said aperture and a cam follower extending from said axial surface, and a stationary cam, said profile defining a cam track in an axial surface;

wherein said stripping pin housing is positioned adjacent to said cam so that said cam followers extend into and are securely positioned in said cam track; and wherein said cam track is defined so that when a cam follower travels around said cam track the stripping pin coupled to said cam follower extends past circumferential surface and then retract below said circumferential surface.

20. The system of claim 19 further including a conveying device operable to carry said sheet of material to said cutting device.

21. The system of claim 19 further including a conveying device operable to carry said blank portion and said waste portion from said cutting device to said waste removal device.

22. The system of claim 19 further including a rotatable drive shaft, said drive shaft coupled to said stripping pin housing.

23. The system of claim 22 further including a stripping pin housing hub wherein said stripping pin housing hub is utilized to couple said drive shaft to said stripping pin housing.

24. The system of claim 22 further including a motor coupled to said drive shaft, said motor operable to rotate said drive shaft.

25. The system of claim 19 further including a cam lock coupled to said cam.

26. The system of claim 25 further including a stationary cam lock shaft coupled to said cam lock.

27. The system of claim 19 wherein said cam is a cylinder.

28. The system of claim 19 wherein said stripping pins extend from said circumferential surface for one half of said circumferential surface.

29. The system of claim 19 wherein said stripping pins extend from said circumferential surface for one quarter of said circumferential surface.

* * * * *